US009011140B2

(12) United States Patent
Carlson

(10) Patent No.: US 9,011,140 B2
(45) Date of Patent: Apr. 21, 2015

(54) REMOTELY ACTUATED PILOT VALVE, SYSTEM AND METHOD

(75) Inventor: Brent J. Carlson, Watertown, WI (US)

(73) Assignee: Baso Gas Products, LLC, Watertown, WI (US)

( * ) Notice: Subject to any disclaimer, the term of this patent is extended or adjusted under 35 U.S.C. 154(b) by 1046 days.

(21) Appl. No.: 12/865,172

(22) PCT Filed: Jan. 30, 2009

(86) PCT No.: PCT/US2009/032575

§ 371 (c)(1), (2), (4) Date: Jul. 29, 2010

(87) PCT Pub. No.: WO2009/097494

PCT Pub. Date: Aug. 6, 2009

(65) Prior Publication Data

US 2011/0003258 A1 Jan. 6, 2011

Related U.S. Application Data

(60) Provisional application No. 61/025,633, filed on Feb. 1, 2008.

(51) Int. Cl.
*F23Q 9/12* (2006.01)
*F23N 5/10* (2006.01)

(52) U.S. Cl.
CPC ..... *F23N 5/102* (2013.01); *F23N 2027/24* (2013.01); *F23N 2035/14* (2013.01)

(58) Field of Classification Search
USPC ..... 431/2, 12–15, 18, 27, 42, 45, 47, 49, 431/51, 52, 54, 60, 72, 81; 251/30.04, 251/129.15
See application file for complete search history.

(56) References Cited

U.S. PATENT DOCUMENTS

| | | | | | |
|---|---|---|---|---|---|
| 2,527,286 | A | * | 10/1950 | Witzel | 431/48 |
| 2,541,410 | A | * | 2/1951 | Crone et al. | 431/54 |
| 2,577,787 | A | * | 12/1951 | Mayer et al. | 431/46 |
| 2,578,717 | A | * | 12/1951 | Mayer et al. | 431/46 |
| 2,584,147 | A | * | 2/1952 | Mayer | 431/56 |
| 2,607,406 | A | * | 8/1952 | Caparone | 431/47 |
| 2,607,415 | A | * | 8/1952 | Jordan | 431/46 |
| 2,607,416 | A | * | 8/1952 | Mayer | 431/46 |
| 2,637,386 | A | * | 5/1953 | Perl et al. | 431/46 |
| 2,637,387 | A | * | 5/1953 | Mayer et al. | 431/46 |
| 2,637,391 | A | * | 5/1953 | Perl et al. | 431/46 |
| 2,637,392 | A | * | 5/1953 | Mayer | 431/46 |
| 2,637,393 | A | * | 5/1953 | Mayer et al. | 431/46 |
| 2,722,945 | A | * | 11/1955 | Gresham | 137/456 |
| 2,895,545 | A | * | 7/1959 | Seegert | 431/47 |
| 3,021,857 | A | * | 2/1962 | Davidson | 137/66 |
| 3,392,740 | A | * | 7/1968 | Fleer | 137/65 |
| 3,429,340 | A | * | 2/1969 | Kosmalski et al. | 137/625.65 |
| 3,813,033 | A | * | 5/1974 | Caparone | 236/9 R |
| 4,178,573 | A | * | 12/1979 | Swanson | 335/255 |

(Continued)

*Primary Examiner* — Jorge Pereiro

(74) *Attorney, Agent, or Firm* — Joseph S. Heino; Patrick M. Bergin

(57) ABSTRACT

A remotely actuated pilot gas valve includes safe lighting and complete shutoff capabilities in the event that the flame that is heating a thermocouple is extinguished. The invention provides for a heater system that utilizes such a pilot gas valve as well as a method whereby the pilot gas valve used in such a system can be remotely and electronically actuated when required. Remote actuation is accomplished by use of a solenoid that is incorporated within the valve design and which is controlled by a remote operator.

13 Claims, 8 Drawing Sheets

(56) References Cited

U.S. PATENT DOCUMENTS

| | | | | |
|---|---|---|---|---|
| 4,242,080 | A * | 12/1980 | Tabei | 431/54 |
| 4,726,055 | A * | 2/1988 | Smith | 379/102.01 |
| 4,962,750 | A * | 10/1990 | Bridgewater | 126/503 |
| 5,018,964 | A * | 5/1991 | Shah | 431/45 |
| 5,450,841 | A * | 9/1995 | Whitaker et al. | 126/512 |
| 5,506,369 | A * | 4/1996 | Kawamura et al. | 84/20 |
| 5,636,653 | A * | 6/1997 | Titus | 137/14 |
| 5,654,813 | A * | 8/1997 | Whitworth | 398/111 |
| 5,722,823 | A * | 3/1998 | Hodgkiss | 431/43 |
| 6,139,327 | A * | 10/2000 | Callahan et al. | 434/224 |
| 6,261,087 | B1 * | 7/2001 | Bird et al. | 431/80 |
| 6,413,079 | B1 * | 7/2002 | Lyons et al. | 431/125 |
| 6,667,594 | B2 * | 12/2003 | Chian | 318/696 |
| 6,724,873 | B2 * | 4/2004 | Senna Da Silva | 379/102.01 |
| 6,892,751 | B2 * | 5/2005 | Sanders | 137/312 |
| 6,934,862 | B2 * | 8/2005 | Sharood et al. | 713/300 |
| 7,479,008 | B2 * | 1/2009 | Thomas | 431/352 |
| 7,507,085 | B2 * | 3/2009 | Happe et al. | 431/18 |
| 7,798,139 | B2 * | 9/2010 | Gagas et al. | 126/25 R |
| 7,823,581 | B2 * | 11/2010 | Velasquez et al. | 126/503 |
| 7,919,732 | B2 * | 4/2011 | Blank et al. | 219/507 |
| 2003/0102025 | A1 * | 6/2003 | Garcha | 137/66 |
| 2004/0226600 | A1 * | 11/2004 | Starer et al. | 136/224 |
| 2005/0221244 | A1 * | 10/2005 | Nguyen | 431/80 |
| 2005/0229969 | A1 * | 10/2005 | Nguyen et al. | 137/240 |
| 2006/0068348 | A1 * | 3/2006 | Blank et al. | 431/78 |
| 2006/0254575 | A1 * | 11/2006 | Velazquez et al. | 126/503 |
| 2006/0260603 | A1 * | 11/2006 | Shah | 126/41 R |
| 2007/0003892 | A1 * | 1/2007 | Huang | 431/24 |
| 2007/0028912 | A1 * | 2/2007 | Gagas et al. | 126/9 R |
| 2007/0128562 | A1 * | 6/2007 | Thomas | 431/125 |
| 2008/0076079 | A1 * | 3/2008 | Eggebrecht et al. | 431/6 |
| 2008/0241772 | A1 * | 10/2008 | Zanella et al. | 431/75 |
| 2009/0047610 | A1 * | 2/2009 | Teng | 431/18 |
| 2011/0003258 | A1 * | 1/2011 | Carlson | 431/2 |

* cited by examiner

REMOTELY ACTUATED PILOT VALVE, SYSTEM AND METHOD

This application claims the benefit and priority of U.S. Provisional Patent Application No. 61/025,633 filed Feb. 1, 2008.

FIELD OF THE INVENTION

This invention relates generally to pilot gas valves of the type that are intended for use with burner systems that require a continuously burning standing pilot light. It also relates generally to pilot gas valves that provide safe lighting and complete shutoff in the event that the flame that is heating a thermocouple is extinguished. Further, this invention relates to such a heater system that utilizes such a pilot gas valve as well as to a method whereby the pilot gas valve used in such a system can be remotely and electronically actuated when required.

BACKGROUND OF THE INVENTION

In the art of heating, the use of gaseous hydrocarbons is well known. This includes natural gas, propane, butane and other hydrocarbon fuels. It is also well known that gas supply valves are used with gas heaters. Such valves are typically used to control the flow of gas and provide safe operation by means of a "thermocouple." Indeed, the concept of a thermocouple literally means the "coupling" of two dissimilar metals to create a voltage potential between them when heat is maintained. If the heat is not maintained, the voltage potential across the thermocouple is not maintained and the electrical circuit created thereby is opened. The thermocouple is used to monitor a pilot, but its real function is to control the gas supply valve.

By way of example, many gas-fueled heating devices make use of such a pilot light to ignite a main gas burner. In a situation where the pilot light would become extinguished, for any reason, there would also be the potential for uncombusted gas to be released into the surrounding area, thereby creating a serious risk of uncontrolled combustion, explosion and fire. To prevent such a dangerous condition, some gas supply valves use the thermocouple to sense when this pilot light is burning. The tip of the thermocouple is placed in the pilot flame. The resultant voltage, though small (typically greater than 8 mV), operates the gas supply valve responsible for feeding the pilot. So long as the pilot flame remains lit, the thermocouple remains hot and holds the pilot gas valve open. If the pilot light goes out, however, the temperature will fall along with a corresponding drop in voltage across the thermocouple leads, thereby removing power from the valve. The valve closes and shuts off the gas, halting this unsafe condition.

In the area of fuel pipelines of the type that are used to transport crude oil, for example, across long distances, it is also well known in the art that heating stations must be placed along the pipeline at intervals that are sufficient to maintain the proper flow viscosity of the oil.

Accordingly, it is an object of the present invention to provide a new and useful pilot valve, system and method that include safe lighting and complete shutoff capabilities in the event that the flame that is heating a thermocouple is extinguished. It is another object of the present invention to provide such a pilot valve, system and method that can be remotely and electronically actuated when required by the operator. It is still another object of the present invention to provide such a pilot valve and a system using a minimal number of parts to fabricate the pilot valve and system. It is yet another object of the present invention to provide such a method using a minimal number of steps to remotely actuate the pilot valve and system when such is required.

SUMMARY OF THE INVENTION

The remotely actuated pilot valve of the present invention has obtained these objects. It provides for a pilot gas valve that includes safe lighting and complete shutoff capabilities in the event that the flame that is heating a thermocouple is extinguished. Further, this invention provides for a heater system that utilizes such a pilot gas valve as well as to a method whereby the pilot gas valve used in such a system can be remotely and electronically actuated when required. Remote actuation is accomplished by use of a solenoid that is incorporated within the valve design and which is controlled by a remote operator.

The foregoing and other features of the present invention will be apparent from the detailed description that follows.

DETAILED DESCRIPTION

Figure 1:
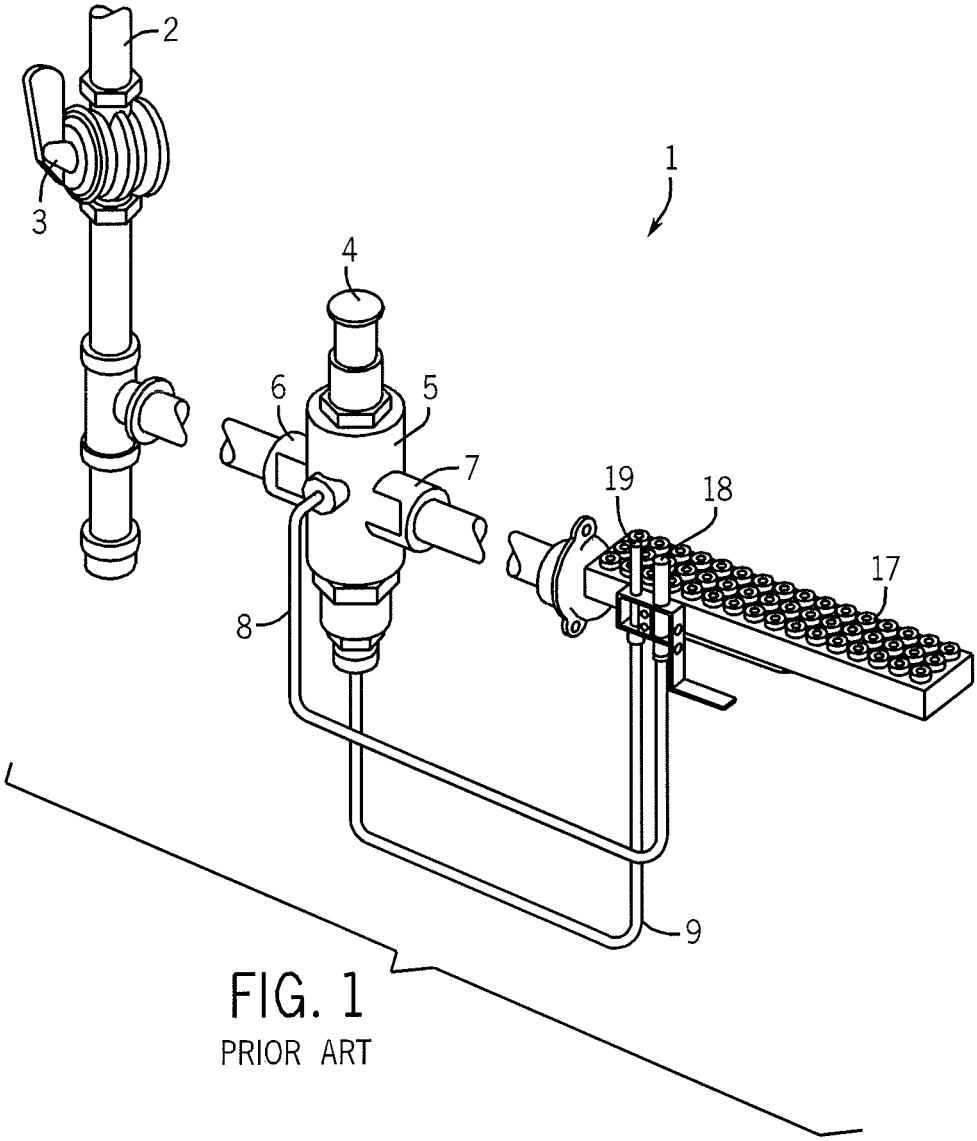
FIG. 1 PRIOR ART
FIG. 1 is a front, top and right side perspective view of a gas pilot valve used in accordance with the prior art.

Referring now to the drawings in detail wherein like numbers represent like elements throughout, FIG. 1 illustrates a perspective view of a typical gas pilot valve assembly, generally identified 1, as it would be constructed in accordance with the prior art. As shown, the assembly 1 includes a gas supply line 2 that includes a supply shut off valve 3. A gas valve 5 includes a gas in port 6 and a gas out port 7. The valve 5 also includes a pilot burner gas line 8 and a pilot burner 18. The valve 5 further includes a thermocouple lead 9 and a thermocouple 19. Finally, the valve 5 includes a manual reset button 4. The gas out port 7 of the valve 5 is connected to a heater array 17, the heater array 17 being placed in close proximity to the pilot burner 18 and the thermocouple 19.

In application, gas flows through the supply line 2 and into the gas valve 5 via the in port 6. The valve 5 supplies gas to the heater array 17 via the out port 7. The valve 5 is also used to divert a smaller supply of gas to the pilot burner 18. As long as the thermocouple 19 senses the flame from the pilot burner 18, gas will continue to flow from the valve 5 and into the array 17. If the array 17 ceases to burn gas and generate the necessary amount of heat to maintain the current flow through the thermocouple 19, the current flow from the valve 5 and through the out port 7 will cease at which point it will be necessary to actuate a reset button 4 on the valve 5 and re-light the pilot burner 18 in order to re-open the valve 5 and establish gas flow through it.

Figure 2:
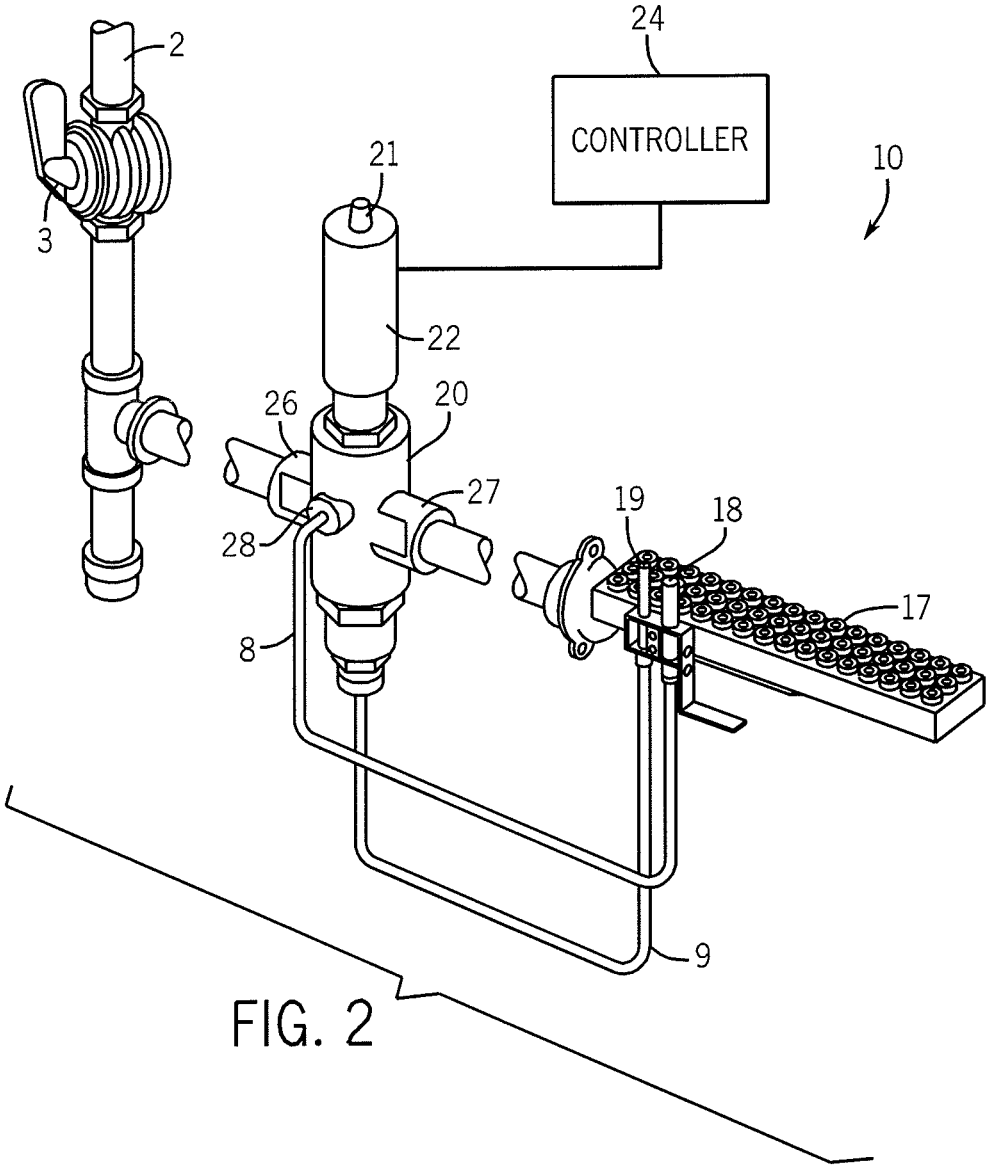
FIG. 2 is a front, top and right side perspective view of a gas pilot valve constructed in accordance with the present invention.

Referring now to FIG. 2, it illustrates a perspective view of a gas pilot valve assembly, generally identified 10, as it would be constructed in accordance with the present invention. As shown, the assembly 10 similarly comprises a gas supply line 2 that includes a supply shut off valve 3. A gas valve 20 in accordance with the present invention includes a gas in port 26 and a gas out port 27. The valve 20 also includes a pilot burner gas line out port 28 that is attached to a pilot burner gas line 8 and a pilot burner 18. The valve 20 further includes a thermocouple lead 9 and a thermocouple 19. Significantly different from the assembly that is illustrated in FIG. 1 is the fact that the valve 20 includes an electronic controller 24, an electronically actuated solenoid reset 22 and a manually actuated reset button 21. As with the assembly 1 of the prior art, the gas out port 27 of the valve 20 is connected to a heater array 17, the heater array 17 being placed in close proximity to the pilot burner 18 and the thermocouple 19.

In application, gas flows through the supply line 2 and into the to gas valve 20 via the in port 26. The valve 20 supplies gas to the heater array 17 via the out port 27. The valve 20 is also used to divert a smaller supply of gas to the pilot burner 18. As long as the thermocouple 19 senses the flame from the pilot burner 18, gas will continue to flow from the valve 20 and into the array 17. If the array 17 ceases to burn gas and generate the necessary amount of heat that is required to maintain the current flow through the thermocouple 19, the current flow from the valve 20 and through the out port 27 will cease. At this point, it would be possible for the valve 20 to be reset by means of the manual reset button 21 on the valve 20 and re-light the pilot burner 18 in order to re-open the valve 20 and establish gas flow through it. Alternatively, and preferably, the electronic controller 24 would be used to electronically actuate the solenoid reset 22 to accomplish the same functionality as that of the manual reset button 21. In the assembly 10 of the present invention, it would be possible to configure the valve 20 such that it would include the electronically actuated reset means only, and such is not a limitation of the present invention. In the preferred embodiment of the assembly 10 of the present invention, it is also desirable to configure the electronically actuated reset means such that the controller 24 is remotely actuated.

Figure 3:
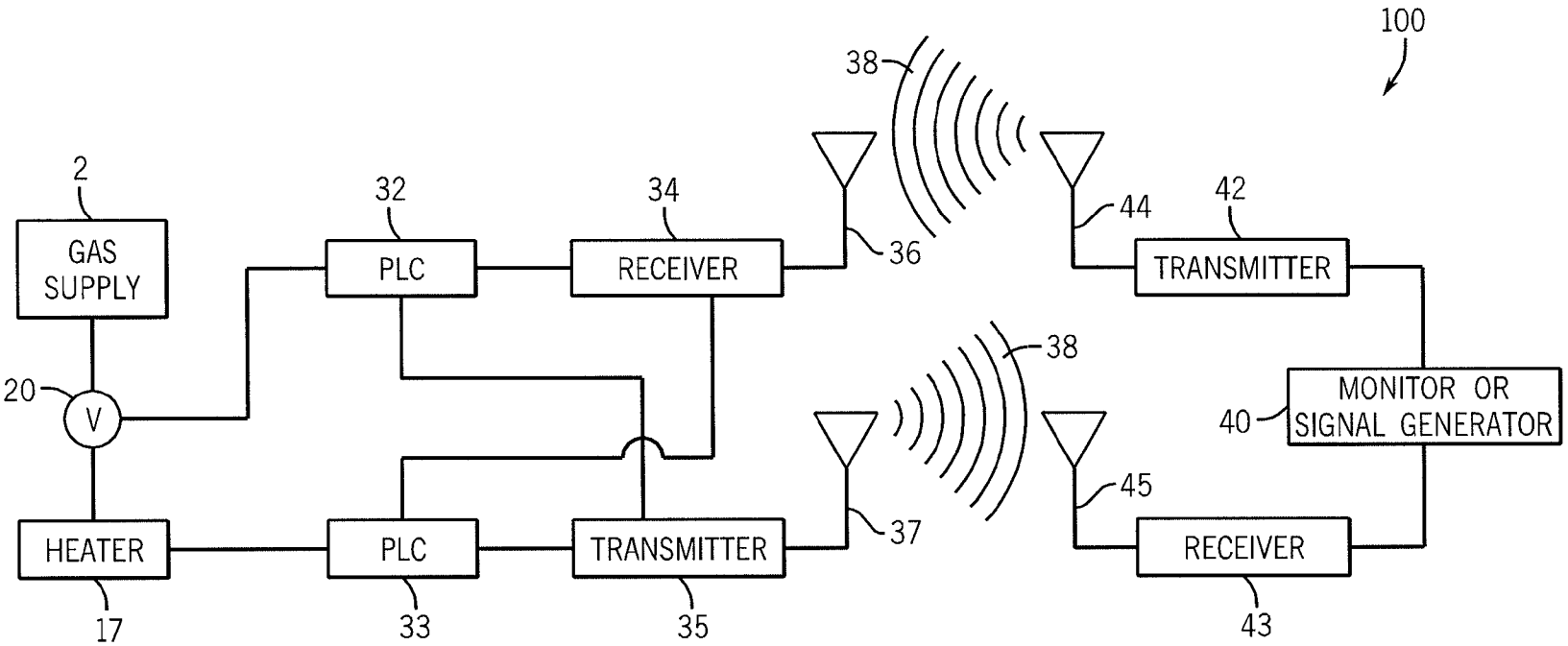
FIG. 3 is a schematic diagram of a system configured in accordance with the present invention.

Referring now to FIG. 3, it illustrates a schematic representation of a preferred embodiment for a remotely and electronically actuated gas valve reset assembly, generally identified 100, that would be configured in accordance with the present invention. Specifically, the gas valve 20 is disposed between a gas supply 2 and a heater 17. These components function substantially in accordance with the detailed description provided above. As shown, however, the gas valve 20 is electronically connected to a programmable logic controller 32 or "PLC" that is used in accordance with a preprogrammed scheme. In this particular configuration, the PLC 32 is, in turn, electronically connected to a receiver 34 and to a transmitter 35. The transmitter 35 is adapted to generate and propagate, by means of an antenna 37, electromagnetic waves 38 of the type that can be received by a remotely located receiver 43, the receiver 43 also being outfitted with an antenna 45. The receiver 43 is electronically connected to a computer which is a monitor or signal generator 40 in this embodiment. This side of the schematically illustrated assembly 100 is intended to be that portion which is capable of controlling the remote actuation of the gas valve 20.

Another side of the assembly shown in FIG. 3 is shown to include a second PLC 33 that is electronically connected to the heater 17. It is to be understood that the first PLC 32 and the second PLC 33 could be one in the same. That is, a single PLC could be used such as where the heater-side PLC 33 is "piggy-backed" by the valve-side PLC 32. Such is not a limitation of the present invention. The second PLC 33 is also electronically connected to the receiver 34 and the transmitter 35 that is adapted to generate and propagate, by means of an antenna 36, electromagnetic waves 38 of the type that can be received by a remotely located second receiver 43, the second receiver 43 also being outfitted with an antenna 45. The second receiver 43 is electronically connected to the monitor or signal generator 40.

In a situation where the gas valve 20 and the heater 17 are shut down, a signal is sent to the second PLC 33 which results in a signal 38 being transmitted from the transmitter 35 via the antenna 37. The signal 38 is picked up by the receiver 43 via the antenna 45 and relayed electronically to the monitor or signal generator 40. At this point, it is to be assumed in this particular embodiment that the heater 17 will need a given amount of time in order to bring the heat up to a level where the remote signal can energize the valve 20. See FIG. 4. In other words, actuation of the pilot light prematurely will result in the pilot light not being sustained, with a second failed condition being relayed to the monitor or signal generator 40. In one practical application, an operator who is not equipped with the remote actuation components as described above would be required to physically go to the place where the heater 17 and gas valve 20 are located, actuate the gas valve 20, wait for a sufficient period of time to reach a sustained heat level, and then manually actuate the gas valve 20, that assembly resembling the type of configuration represented by FIG. 1. This results in substantial time and expense to physically transport the operator to the site of installation of the valve 20 and heater 17 as well as substantial expense related to the operator's "down time" as he or she waits to manually actuate the gas valve 20. In some applications, manual actuation requires that an operator walk into a remote area through woods, snow, rock, etc., and sometimes for miles, to perform this operation.

By contrast, the embodiment illustrated by FIG. 3 allows the operator to assess the situation from the monitor or signal generator 40, or even from a phone line (not shown), and to remotely initiate a reset sequence without the need to be physically in the location of the valve 20 and the heater 17. In this sequence the transmitter 42 and antenna 44 transmit a signal 38 that is picked up by the receiver 34 and antenna 36. The receiver 34 then sends a signal to the PLCs 32, 33 to reignite the heater 17 and allow it sufficient time to reach a sustainable heat level for the valve 20. Once that is done, the operator can use the monitor or signal generator 40 to send a second signal to the valve 20 to allow it to reset automatically, thereby reactivating the operation of the valve 20 and operation of the heater 17 continues as intended. In this particular embodiment, it is also preferred to allow a manual override for operation of the valve 20 in the event of other unanticipated failures, such as where a catastrophic electrical failure would prevent proper operation of the electronics mentioned herein. The use of this type of system in the situation discussed above where an operator would otherwise need to walk into a remote area through woods, snow, rock, etc., and sometimes for miles, to perform manual valve actuation is indeed beneficial. In another application, use of the remote actuation of the gas valve 20 could be beneficial in heater systems where, for example, infrared heaters are located at substantial heights above the floor of a facility where physically reaching them poses a potential hazard for the operator who has to manually actuate a supply gas valve 20. Other applications are also possible and any one of those mentioned here is not a limitation of the present invention.

Figure 4:
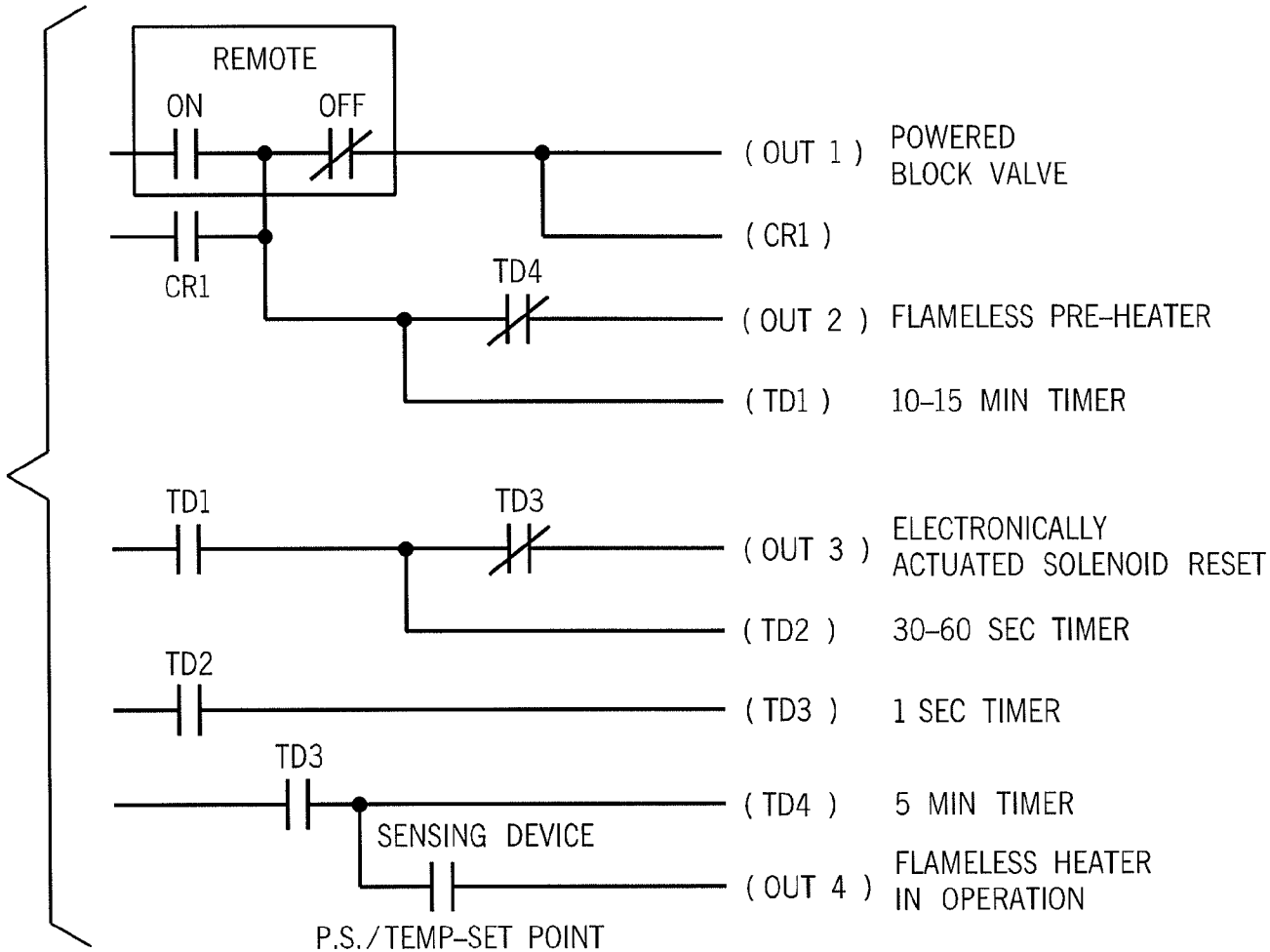
FIG. 4 is an electrical ladder diagram illustrating the functionality of the gas pilot valve constructed in accordance with the present invention.

Referring now to FIG. 4, it shows an electronic ladder diagram of operation of the valve 20 in a system where a "flameless" pre-heater (not shown) is used with the valve 20 and following a situation where the system detects a heating failure, all in accordance with a pre-programmed scheme. Starting at the top of the ladder, it will be seen that, once the remote "ON" signal that is sent remotely by the operator is received by the PLC, the internal relay CR1 normally-open contact is closed. Power is thereby provided to output OUT 1. At the same time, output OUT 2 is on to start heating the flameless pre-heater and to actuate the internal timer TD1 to start timing. In this example, the time delay is pre-programmed at 10 to 15 minutes. During this 10 to 15 minute period, the flameless pre-heater is heating the tip of the thermocouple. After the internal timer TD1 times out, the TD1 normally-open contact closes thereby energizing output OUT 3 which energizes the electronically-actuated solenoid reset and the internal timer TD2 which starts timing. In this example, the time delay is pre-programmed at 30 to 60 seconds. During this 30 to 60 second period, the solenoid push pin is down and holding the seal open. Gas is flowing to the flameless heater. After the 30 to 60 second period has passed, the TD2 normally-open contact closes thereby energizing internal timer TD3, which is set for a one second time delay. After one second, the TD3 normally-closed contact opens thereby de-energizing the solenoid OUT 3 allowing the solenoid push pin to go up while the seal stays down. The TD3 normally-open contact closes thereby energizing the timer TD4, which is set for a 5 minute time delay. During this 5 minute period, the sensing device will send a signal to the PLC that the flameless heater is in operation by means of OUT 4. After 5 minutes, the TD4 normally-closed contact opens to de-energize the pre-heater and the flameless heater continues to operate properly until its operation is again interrupted for one reason or another. It is to be understood that this example is provided solely for purposes of understanding the operation of the device, system and method of the present invention and is not limiting in any way. Other pre-programmed schemes could be used as well.

Figure 5:
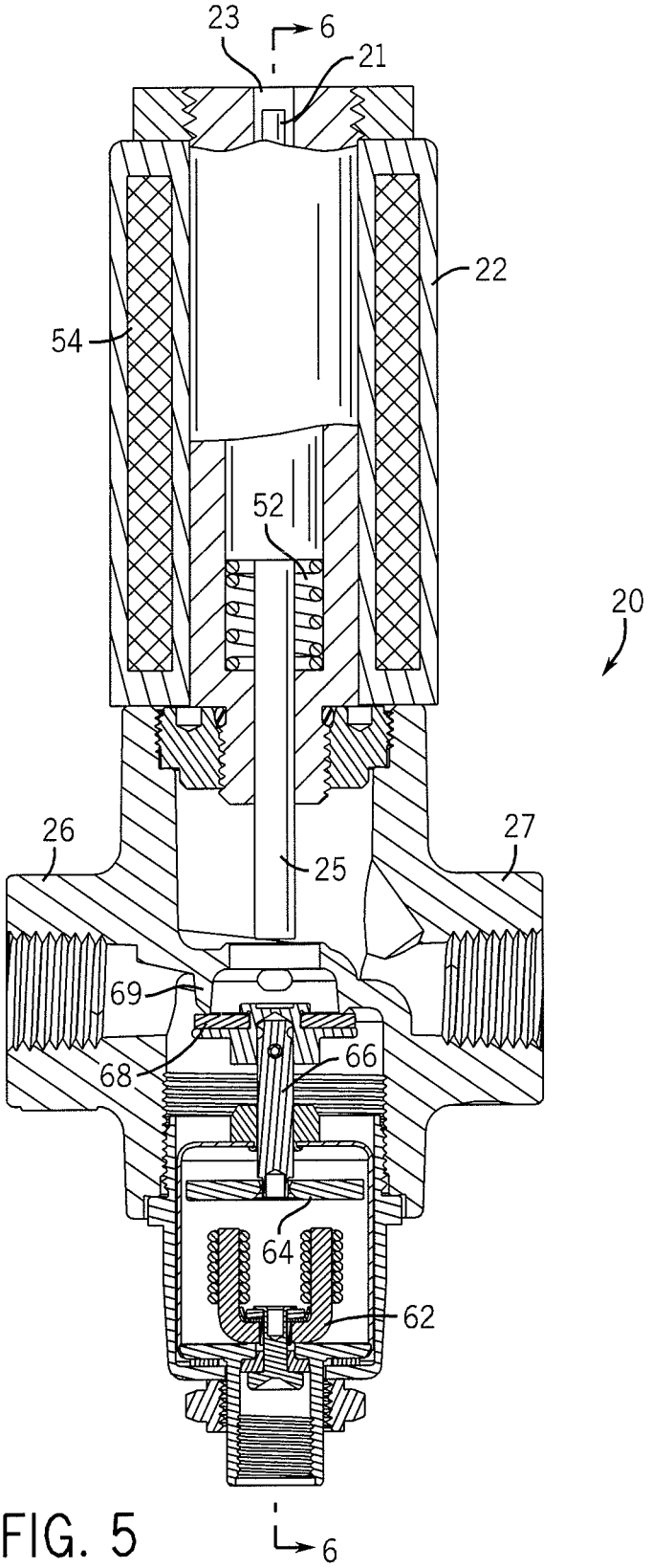
FIG. 5 is an enlarged and cross-sectioned front elevational view of the gas pilot valve constructed in accordance with the present invention.
Figure 6:
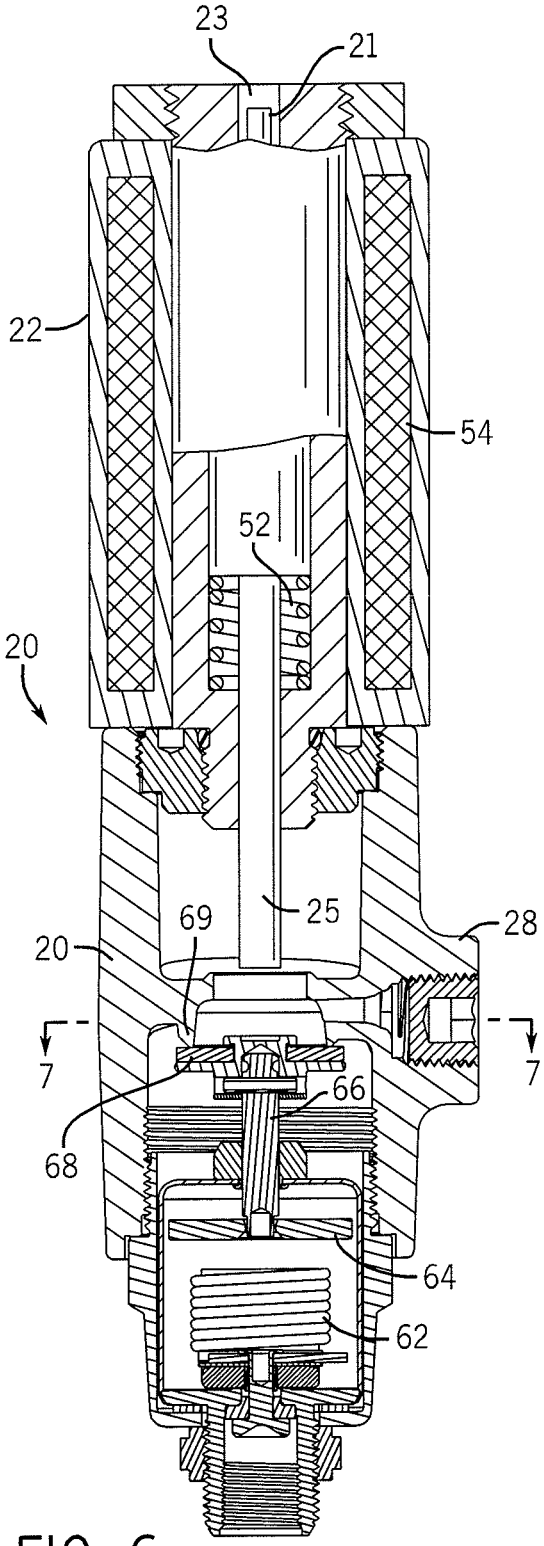
FIG. 6 is a right side elevational and cross-sectioned view of the gas pilot valve taken along line 6-6 of FIG. 5.
Figure 7:
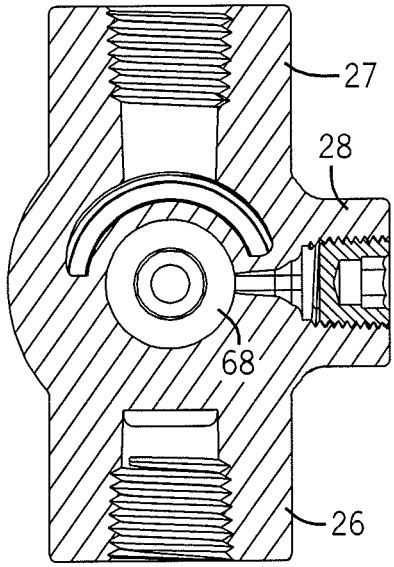
FIG. 7 is a top plan and cross-sectioned view of the gas pilot valve taken along line 7-7 of FIG. 6.

Referring now to FIGS. 5-7, they show the detailed internal structure of a remotely actuated pilot valve, again generally identified 20, that is constructed in accordance with the present invention. A gas in port 26 and gas out port 27 are provided, as is a pilot burner gas line out port 28. Atop the valve 20 is the remotely and electronically actuable solenoid 22. The solenoid 22 includes electromagnetic windings 54 that are used to create an electromagnetic field within the solenoid 22 when the solenoid 22 is to be actuated. The solenoid 22 includes a spring-loaded push pin 25 that biases the push pin 25 to a first position as shown. In this position, the push pin 25 includes an uppermost end 21, a portion of which extends upwardly through a solenoid aperture 23 and above the upper flat surface of the solenoid 22. This feature allows for a manual override of the solenoid 22 when such is desired or required. The valve 20 also includes an electromagnet 62 that maintains a plate 64 in contact with the electromagnet 62 when the current through the thermocouple (not shown) is maintained. When the current is not maintained, as in conditions described earlier, the electromagnet 62 is unable to maintain its connection with the plate 64. This plate 64 is attached to one end of a connector 66, the other end of the connector 66 being attached to a spring-biased seal 68. The seal 68 is used with a seat 69 to stop the flow of gas through the valve 20. In the position that is shown in FIGS. 5 and 6, the solenoid push pin 25 is then movable downwardly when the solenoid 22 is actuated to urge the seal 68 downwardly and away from the seat 69 as well. This then allows the thermocouple to reestablish the electromagnetic connection within the valve 20 and the gas to flow through it.

Figure 10:
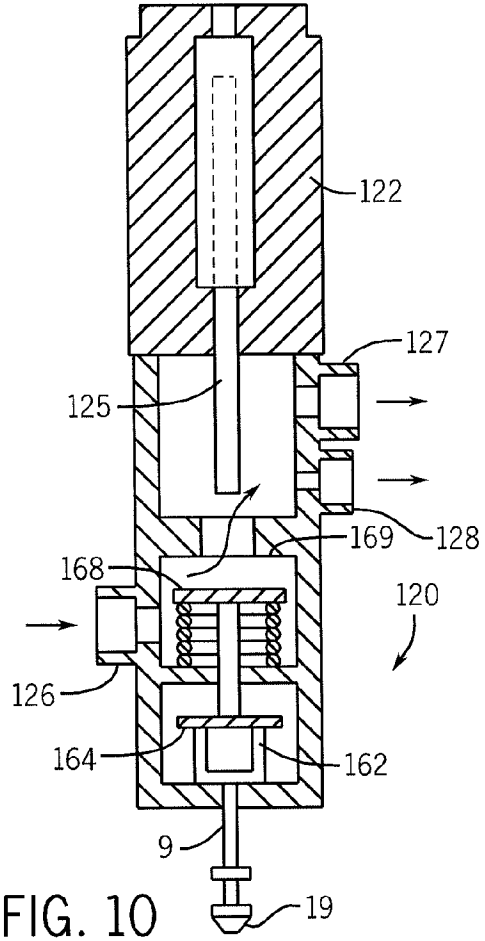
FIGS. 8-10 are cross-sectioned schematic views of a "non-interrupt" type gas pilot valve that is constructed in accordance with the present invention.
Figure 9:
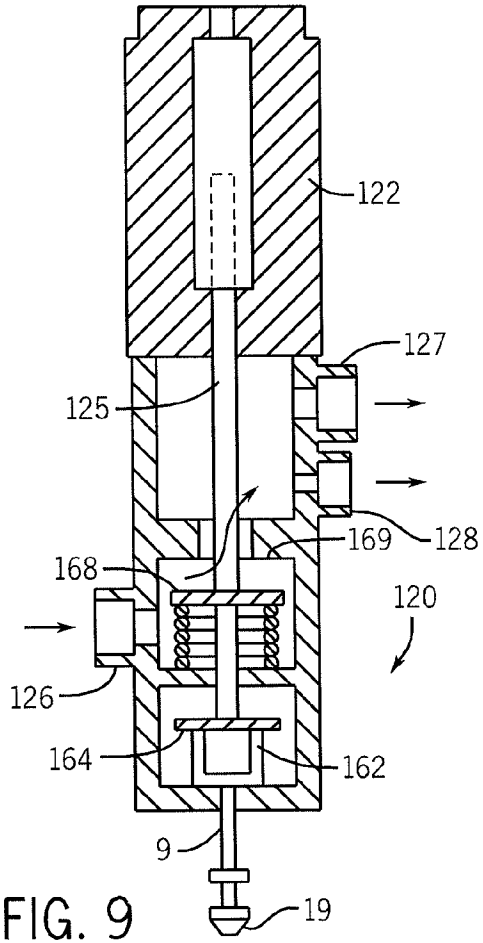
Figure 8:
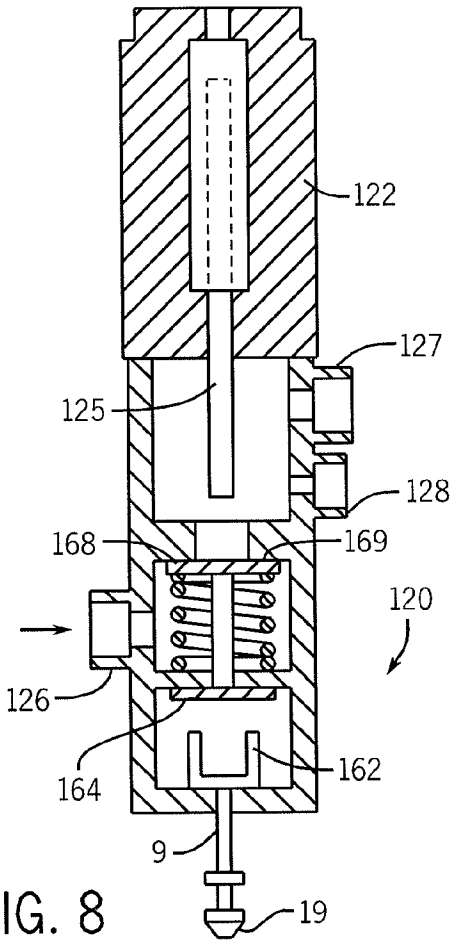

Referring now to FIGS. 8-10, they show the sequence of operation of a "non-interrupt" type gas valve 120 that could be used in accordance with the present invention. Specifically, FIG. 8 illustrates the situation where the valve 120 is in a closed position. The connection between the electromagnet 162 and the plate 164 has been broken due to a condition that has caused the thermocouple 19 to decrease the current through its connection 9 with the valve 120. In short, nothing is functioning. In FIG. 9, it will be seen that the solenoid 122 is actuated to push the seal 168 away from the seat 169. This allows gas flow through in port 126 and through the pilot port 128 or the out port 127. The pilot port 128 could be plugged or open depending on the need. The valve 120 will not hold "open" until the thermocouple 19 carries sufficient current. FIG. 10 illustrates that the thermocouple 19 now has sufficient current, thus allowing the valve 120 to stay open. The solenoid 122 will have no electrical flow, thus allowing the push pin 125 to return. The valve 120 will stay open for gas flow through the out port 127 as long as the thermocouple current is sustained.

Figure 13:
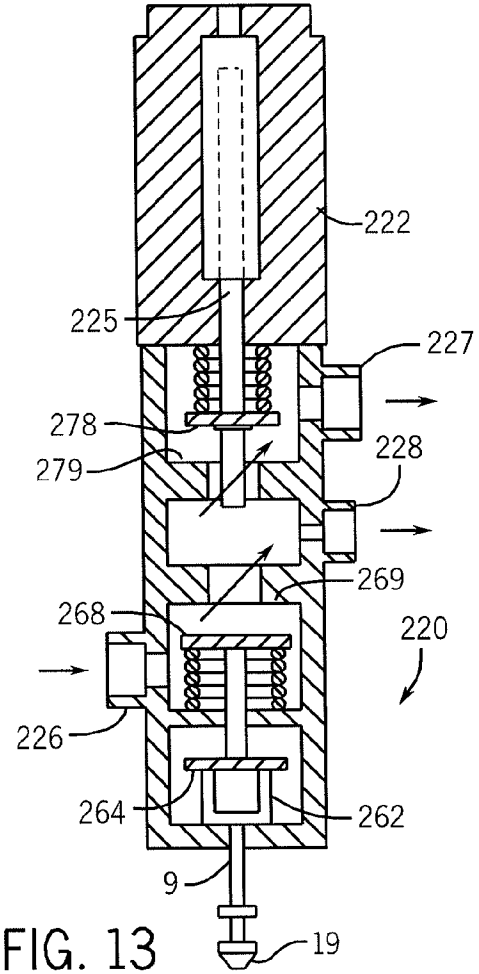
FIGS. 11-13 are cross-sectioned schematic views of an "interrupt" type gas pilot valve that is constructed in accordance with the present invention.
Figure 12:
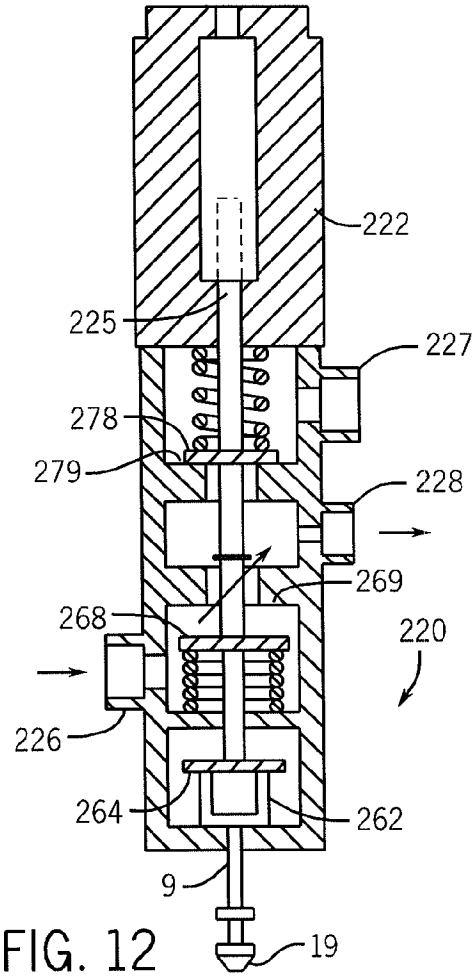
Figure 11:
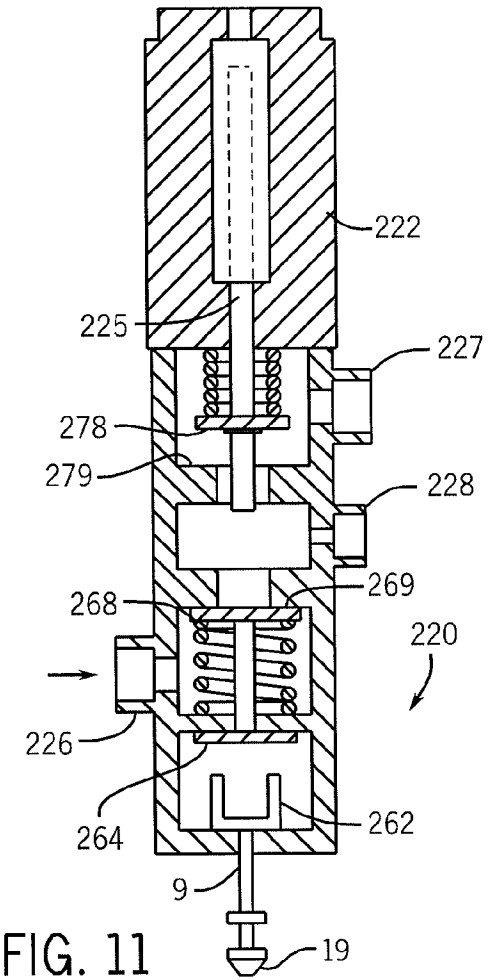

Referring now to FIGS. 11-13, they show the sequence of operation of an "interrupt" type gas valve 220 that could be used in accordance with the present invention. Specifically, FIG. 11 similarly illustrates the situation where the valve 220 is in a closed position. That is, the connection between the electromagnet 262 and the plate 264 has been broken due to a condition that has caused the thermocouple 19 to decrease the current through its connection 9 with the valve 220. In short, there is no gas flow through the valve 220. In FIG. 12, it will be seen that the solenoid 222 is actuated to push the seal 268 away from the seat 269. It will also be seen that this actuation of the solenoid 222 also works to push a secondary seal 278 against a secondary seat 279. This allows gas flow through in port 226 and through the pilot port 228 but not through the out port 227. FIG. 13 illustrates that the thermocouple 19 now has sufficient current, thus allowing the valve 120 to stay open because the seals 268, 278 are moved away from their respective seats 269, 279. The valve 120 will stay open for gas flow through the out port 127 as long as the thermocouple current is sustained.

Based upon the foregoing, it will be seen that there has been provided a new and useful remotely actuable gas pilot valve that provides safe lighting and complete shutoff in the event that the flame or heat source that is heating a thermocouple is extinguished. There has also been provided a new and useful heater system that utilizes such a pilot gas valve and a method whereby the pilot gas valve used in such a system can be electronically actuated by a remote operator when required.

The details of the invention having been disclosed in accordance with the foregoing, I claim:

1. A gas pilot valve that is remotely actuated via a wireless electromagnetic signal that is transmitted from an antenna, the valve comprising:

a gas in port;

a gas out port;

a pilot burner gas out port;

an electronically actuable solenoid, the solenoid comprising electromagnetic windings that are functionally adapted to create an electromagnetic field within the solenoid when the solenoid is electrically actuated via the wireless electromagnetic signal, and the solenoid further comprising a spring-loaded push pin and a spring that is used with the push pin, the push pin spring being disposed fully within the solenoid and further disposed to urge the push pin upwardly, the solenoid further comprising a spring-loaded push pin having an uppermost end that extends above the solenoid for manually actuated resetting of the seal via the uppermost end of the push pin;

a seal, the seal being normally held in a first position where gas flows from the gas in port to the gas out port; and means for remotely actuating the solenoid via either the wireless electromagnetic signal when the signal is received by an antenna or manually such that the push pin is urged downwardly by the actuated solenoid to reset the seal to the first position after the seal is in a second position where gas is prevented from flowing from the gas in port to the gas out port.

2. The pilot valve of claim 1 wherein the solenoid further comprises:

a plate;

an electromagnet, the electromagnet maintaining the plate in contact with the electromagnet when current flow through the electromagnet is maintained;

a spring-bias means for urging the plate away from the electromagnet; and a connector, the connector comprising a first end connected to the plate and a second end connected to the seal.

3. The pilot valve of claim 1 wherein the means for remotely actuating the solenoid further comprises a programmable logic controller, the controller being electronically connected to the gas valve solenoid.

4. The pilot valve of claim 3 wherein the means for remotely actuating the solenoid via a wireless electromagnetic signal further comprises:

an electromagnetic signal receiver that is electronically connected to an antenna; and an electromagnetic signal transmitter that is electronically connected to an antenna;

wherein the receiver and the transmitter are electronically connected to the PLC for controlling the remote actuation of the solenoid via the wireless electromagnetic signal that is transmitted and received by the antennas.

5. The pilot valve of claim 1 wherein the valve is configured as an interrupt-type valve.

6. The pilot valve of claim 1 wherein the valve is configured as a non-interrupt-type valve.

7. A gas heater system that uses the pilot valve of claim 1 comprising:

a gas supply line;

a thermocouple and a thermocouple lead;

a manually actuated reset button; and a gas heater array, the gas heater array being connected to the gas out port of the valve and the gas heater array being placed in proximity to the pilot burner and the thermocouple.

8. The system of claim 7 wherein the means for remotely actuating the solenoid further comprises a programmable logic controller, the controller being electronically connected to the gas valve solenoid.

9. The system of claim 8 wherein the means for remotely actuating the solenoid further comprises:

an electromagnetic signal receiver; and an electromagnetic signal transmitter;

wherein the receiver and the transmitter are electronically connected to the PLC for controlling the remote actuation of the solenoid via the wireless electromagnetic signal.

10. A method for remotely actuating the gas pilot valve in the system of claim 9 comprising the steps of:

processing a first signal to reignite the heater array;

waiting a sufficient time to allow the heater array to read a sustainable heat level; and processing a second signal to reset the gas pilot valve.

11. A method for remotely actuating the pilot valve of claim 1 the method comprising the steps of:

providing a programmable logic controller as the means for remotely actuating the solenoid;

electronically connecting the controller to the solenoid;

providing an electromagnetic receiver;

providing an electromagnetic transmitter;

electronically connecting the receiver and the transmitter to the programmable logic controller;

electronically controlling the remote actuation of the solenoid via the wireless electromagnetic signal; and actuating the controller to reset the seal in accordance with a pre-programmed scheme.

12. The method of claim 11 further comprising the steps of:

providing the spring-loaded push pin with an uppermost end extending above the solenoid for manually resetting the seal; and manually resetting the seal via the uppermost end of the push pin.

13. A gas pilot valve that is remotely actuated via a signal from a telephone land line comprising:

a gas in port;

a gas out port;

a pilot burner gas out port;

an electronically actuable solenoid, the solenoid comprising electromagnetic windings that are functionally adapted to create an electromagnetic field within the solenoid when the solenoid is electrically actuated via the signal from the telephone land line, and the solenoid further comprising a spring-loaded push pin and a spring that is used with the push pin, the push pin spring being disposed fully within the solenoid and further disposed to urge the push pin upwardly;

a seal, the seal being normally held in a first position where gas flows from the gas in port to the gas out port; and means for remotely actuating the solenoid via the telephone land line signal such that the push pin is urged downwardly by the actuated solenoid to reset the seal to the first position after the seal is in a second position where gas is prevented from flowing from the gas in port to the gas out port.

* * * * *